United States Patent [19]

Waters

[11] 4,065,856

[45] Jan. 3, 1978

[54] MAINTENANCE MACHINES FOR RAILWAY TRACK

[75] Inventor: John M. Waters, Derby, England

[73] Assignee: British Railways Board, London, England

[21] Appl. No.: 683,139

[22] Filed: May 4, 1976

Related U.S. Application Data

[63] Continuation of Ser. No. 469,719, May 14, 1974, abandoned.

[30] Foreign Application Priority Data

May 23, 1973 United Kingdom ..... 24637/73

[51] Int. Cl.[2] ..... E01B 29/04

[52] U.S. Cl. ..... 33/287; 404/84; 104/7 R

[58] Field of Search ..... 104/12, 7 R, 7 B; 33/287, 1 Q, 86; 404/84; 356/141, 152–154

[56] References Cited

U.S. PATENT DOCUMENTS 3,381,626 5/1968 Fagan et al. ..... 33/287

FOREIGN PATENT DOCUMENTS 612,392 1/1961 Canada ..... 404/84

1,202,403 8/1970 United Kingdom ..... 33/287

*Primary Examiner*—Harry N. Haroian

*Attorney, Agent, or Firm*—Fred Philpitt

[57] ABSTRACT

An optical system for establishing a reference datum in relation to which operations can be carried out in roadway workings comprises optical devices which define an optical triangle whose plane inclines downwardly towards the plane of the roadway. The inclination of the plane of the optical triangle is adjustable so that a corner of the triangle is set at the level of the roadway as determined by a reflected image of the roadway surface.

10 Claims, 14 Drawing Figures

MAINTENANCE MACHINES FOR RAILWAY TRACK

This is a continuation of application Ser. No. 469,719, filed May 14, 1974, now abandoned.

This invention relates to optical systems for establishing a reference datum in relation to which operations can be carried out in roadway workings. By the term "roadway" is meant any way along which vehicles run, the invention having particularly advantageous application with maintenance machines for correcting the level of railway track.

In order to correct the level of railway track it is customary to establish a datum line extending from a rear datum founded on the track which has already been corrected to a front datum founded on the track which has still to be corrected. The track is then adjusted vertically at an intermediate position until sensing means at the intermediate position intersects the datum line.

During process of the machine along the track the front datum has to be removed forward either in stages or continuously over the uncorrected track and, due to irregularities in the track, this will produce errors in the height of the datum line at the intermediate position.

In most machines the rear datum and the intermediate position are on the same vehicle. The front datum can be on the same vehicle as the rear datum and intermediate position or on a separate vehicle. When the front datum is on the same vehicle as the rear datum and intermediate position the distance between the front and rear datums has to be kept within reasonable limits and, as will be explained, the smaller the distance the greater the error in the height of the datum line at the intermediate position. When the front datum is on a separate vehicle the distance between the front and rear datums can be made satisfactorily large. In such a machine however considerable time is taken up deploying and recovering the front datum carrying the vehicle and this is particularly disadvantageous where track occupations are both difficult to obtain and limited in duration.

One object of this invention is to provide a system for establishing a front datum at a satisfactorily large distance from a rear datum without the disadvantages associated with the deployment and recovery of a special front datum carrying vehicle.

According to the invention an optical system for datum establishment comprises means for establishing an optical triangle whose plane inclines downwardly towards the plane of the roadway, the inclination of the plane of the optical triangle being adjustable so that a corner of the triangle is set at the level of the roadway as determined by a reflected image of the roadway surface.

By the term "optical triangle" is meant an optical system which defines three non-linear points in fixed relationship with each other.

The invention will now be further explained by way of example with reference to the accompanying diagrammatic drawings, in which:

FIG. 1 is a diagram explaining the problem with which the invention is concerned, FIGS. 2 and 3 show in plan and elevation the basic principle of the invention, FIGS. 4 and 5 are elevational and plan views respectively of one optical system in accordance with the invention as applied to a maintenance machine for correcting the level of railway track, FIG. 6 shows a dual optical system using the same principle as the system of FIGS. 4 and 5

Figure 1:
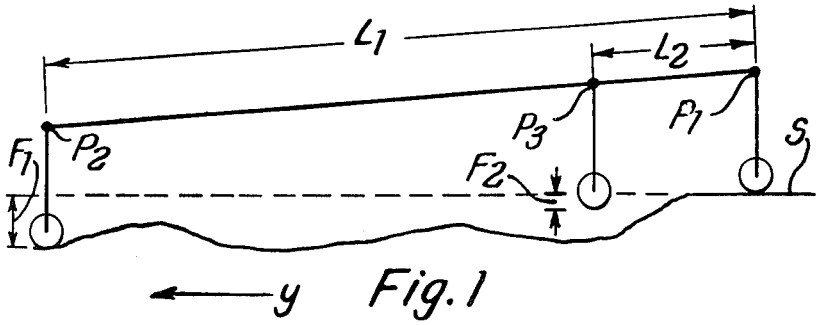

Referring to FIG. 1 this shows a known datum establishing system used with maintenance machines for railway track where $P_1$ is a rear datum, $P_2$ is a front datum so that the line joining $P_1$ and $P_2$ constitutes a datum line. S represents the surface of the railway track; either the ballast-sleeper surface or the rail surface. It will be seen that the datum $P_1$ is founded on the already corrected track and datum $P_2$ is founded on the track still to be corrected, so that as the maintenance machine moves forward in the direction of arrow Y (also inserted on other Figures to indicate the direction of movement) the vertical level of the datum $P_2$ follows the undulations of the uncorrected track. These undulations have been shown somewhat exaggerated for convenience of explanation. The distance $L_1$ is the length of the datum line and the distance $L_2$ is the distance between the rear datum $P_1$ and an intermediate position $P_3$ at which sensing means is located so that track lifting is effected by the machine until the sensing means intercepts the datum line as shown.

If the front datum $P_2$ is considered to have a vertical error of $F_1$ due to the undulations in the track surface, then the intermediate position will have an error of $F_2$ i.e. the track will be under-lifted by $F_2$, given by $$F_2 = F_1 (L_2/L_1)$$

It is clear therefore that the track lifting error at the intermediate position can be minimised by making the ratio $L_1$:$L_2$ large. In a similar way it can be shown that the improvement effected in a track containing faults of a wave form rather than a step form is increased as the ratio $L_1$:$L_2$ increases. As previously stated if the datum $P_2$ is carried by the same vehicle as datum $P_1$ then the distance $L_1$ is relatively small and a typical value for $L_1$:$L_2$ is 4:1. Where the datum $P_2$ is carried by a separate vehicle a typical value of $L_1$:$L_2$ is 10:1.

Figure 2:
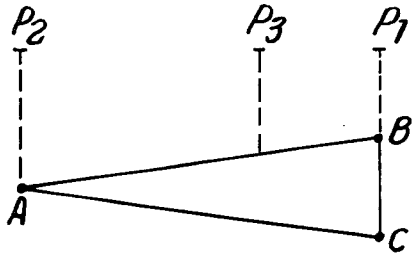
Figure 3:
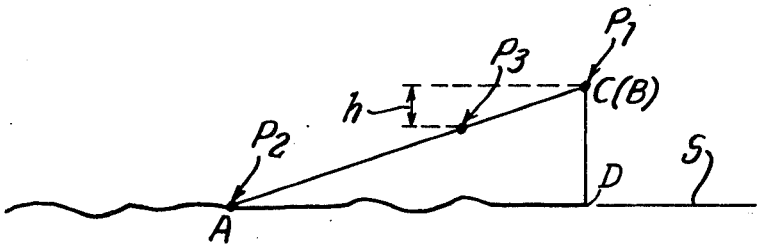

Referring now to FIGS. 2 and 3 these show in plan and elevation the basic principle of the invention. Thus points A, B and C define an optical triangle whose plane slopes down from a predetermined height at BC to the track surface S so that the point A lies in the plane of the track as determined by light reflection from the track surface. With this arrangement B and C are at a constant height above D. AB and AC are constant. The point B or the point C can therefore be considered analogous to the rear datum $P_1$ and the point A can be considered analogous to the front datum $P_2$. The plane ABC thus constitutes a datum plane which can be utilised to control the movement of a track lifting device at the intermediate position $P_3$ on the machine. With this arrangement the point A of the optical triangle ABC and therefore the front datum $P_2$ can be positioned at a relatively great distance from the rear datum $P_2$ constituted by line BC without the need to deploy a special front datum carrying vehicle. The resultant variation in the vertical distance '*h*' which variation corresponds to the error $F_2$ in FIG. 1 will be very small.

Figure 4:
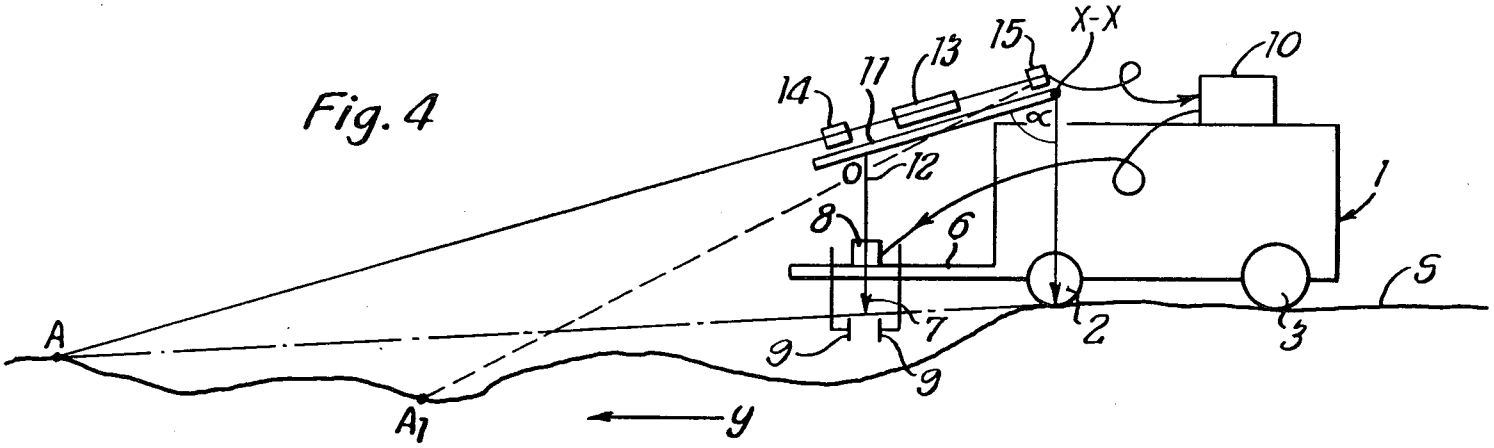
Figure 5:
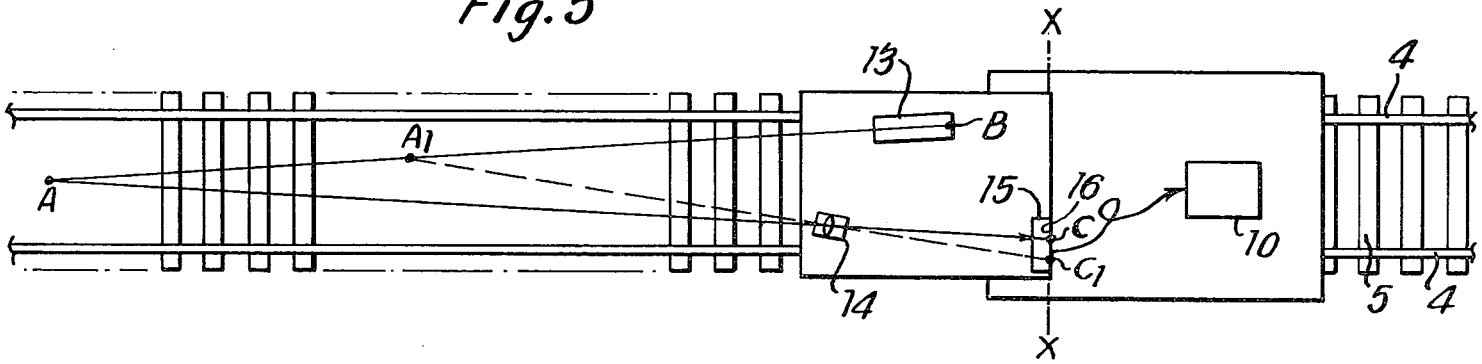

Referring now to FIGS. 4 and 5, these show a practical embodiment of the invention for correcting the level of railway track and comprising a conventional track lifting and ballast tamping machine 1 on which is mounted an optical datum establishing system in accordance with the invention. The machine 1 has front and rear supporting wheels 2 and 3 which run on the track rails 4 tied by ballast supported sleepers 5 (FIG. 5). Extending forwardly of the front wheels 2 is a beam structure 6 carrying conventional track lifting and ballast tamping devices. Thus during a track lifting and tamping operation the machine 1 stands on the already corrected track. The track lifting device which is represented diagrammatically at 7 engages under the rail head and is then raised vertically by hydraulic actuator 8 to lift the rail and adjacent sleepers. Simultaneously the tamping devices which are represented diagrammatically at 9 tamp ballast under the adjacent sleepers 5. Operation of the actuator 8 is controlled by control unit 10, the actuator 8, control unit 10 and the optical datum establishing system now to be described forming a closed control loop.

The optical datum establishing system has a supporting table 11 which is pivotally mounted on the machine 1 on horizontal axis X—X extending transversely of the track. The pivotal axis X—X is located vertically above the front wheels 2 of the machine 1 and is therefore at a known constant height above the track. At a position forward of the pivotal axis X—X the table 11 is supported by a post 12 which is mechanically linked for vertical movement with the lifting device 7. Hence as the track lifting device 7 rises the table 11 pivots upwardly about axis X—X and for any given position of the lifting device 7 there is a corresponding angle of slope of the table 11.

The table 11 carries a light emitter 13, a lens system 14 and an image receiver 15, the receiver 15 being effectively mounted on pivotal axis X—X although this is not essential. The emitter 13 may take the form of a spotlight arranged to emit a beam of white or monochromatic light or a laser beam. The lens system 14 picks up the reflection from the track of the beam from emitter 13 and projects it on to receiver 15. The receiver 15 comprises a photoelectric detector whose electrical output is fed to the control unit 10. The receiver 15 has an image receiving surface 16 extending along the axis X—X, the control arrangement being such that when the received light beam strikes the receiving surface 16 at a predetermined null position, as will be described, operation of the actuator 8 is stopped by the control unit 10 to arrest further vertical movement of the lifting device 7.

The emitter 13 is positioned on the table 11 at point B so that its beam of light is directed towards the longitudinal centre line of the track and depending on the slope of the table 11 will strike the track at varying distances in front of the machine at points such as $A_1$, A between the rails 2 of the track. The lens system 14 will project a reflected image of points $A_1$, A etc. on the image receiving surface 16 of the receiver 15 and it will be seen from FIG. 5 that the reflected image $C_1$ of point $A_1$ is displaced along the axis X—X from the reflected image C of point A. Thus assuming that the points ABC form the desired optical triangle as described with reference to FIGS. 2 and 3, then the point C on the image plane is chosen to be the null position of the receiver 15.

In operation the machine 1 is moved along the track to a required track lifting position and the track lifting device 7 is lowered to engage under the rail head. Assuming this causes the table 11 to have a slope such that the beam from emitter 13 strikes the track at $A_1$ the reflected image in receiver 15 is at $C_1$. The actuator 8 is then operated to raise the lifting device 7 and with it the table 11 so that the reflected image in the receiver 15 moves from $C_1$ towards C. The output from the receiver will cause the control unit 10 to maintain operation of the actuator 8 until the reflected image reaches the null point C. Operation of the actuator will then cease and the raising movement of lifting device 7 will be arrested. Hence at each track lifting position the track will be raised until the desired optical triangle ABC has been achieved and this will result in consistent lifting in relation to a constant datum line constituted by reflected beam AC. Since reflected beam AC can be made relatively long by choosing an appropriate large value for the angle $\alpha$ the lifting error analogous to $F_2$ in FIG. 1 will be small.

It will be readily appreciated that the same result could be achieved with the optical triangle ABC in a vertical plane, i.e. with the table 11 in a vertical plane but still pivoting on horizontal axis X—X. In this case the image receiving surface 16 of receiver 15 would extend vertically so that the image positions C and $C_1$ would be displaced vertically from one another. The plane of the optical triangle ABC could also be disposed at any other angle to the horizontal.

When the emitter 13 produces a monochromatic light beam, the receiver 15 could with advantage incorporate a narrow band pass optical filter to minimise problems associated with ambient light. Also for both monochromatic or white light, the beam of light from emitter 13 could be modulated to facilitate detection by the receiver 15. Phase sensitive amplifiers could also be incorporated.

As an alternative to the automatically operating closed loop control system described above, a manual system could be used. In this case a sighting telescope provided with a vertical hair line and having its optical axis along AC could be used. Upward movement of the lifting device and hence of the table 11 would be arrested manually when the reflection from the track of the beam BA was centred on the hair line of the telescope. Other forms of receiver could of course be used.

Figure 6:
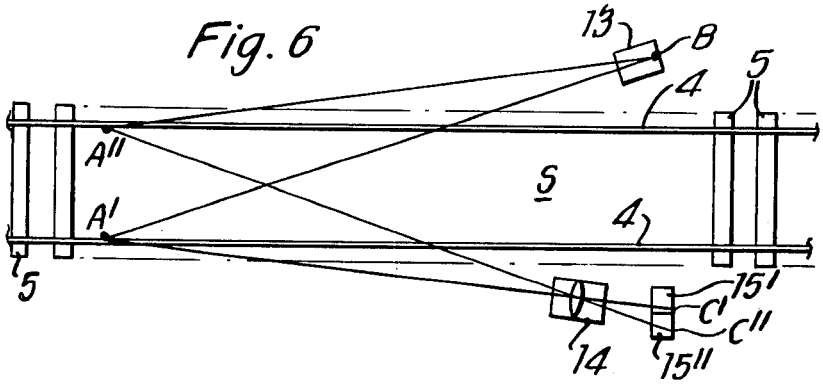

A dual system comprising two transmitters or a single transmitter 13 incorporating a beam splitter at B a lens system 14 and two receivers 15' and 15'' which receive reflected images from points A' and A'' on opposite sides of the longitudinal centre line of the track to form two optical triangles A'BC' and A''BC'' offset to either side of the centre line is shown diagrammatically in FIG. 6. This allows cross-fall of the track to be taken into account, i.e. lifting of the two rails 4 to different levels for example at curves in the track.

Figure 7:
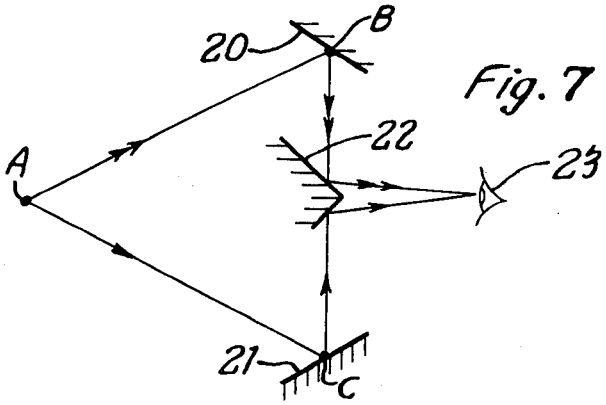
FIG. 7 shows an embodiment of the invention using a range-finder technique.

In FIG. 7 is shown an embodiment of the invention using a range-finder technique. Reflecting surfaces, e.g. mirrors, 20 and 21 are mounted on a table corresponding to table 11 in FIGS. 4 and 5 and are angled so that they reflect images onto the split image or superposed image device 22 having two reflecting surfaces at an angle to each other which reflects these images to viewing position 23. It will be appreciated that the reflected images will be of the same point of the track for only one angle of slope of the table. For only one slope of the table will an optical triangle be formed and by suitable angling of the surfaces B and C this can be the desired optical triangle ABC.

Figure 8:
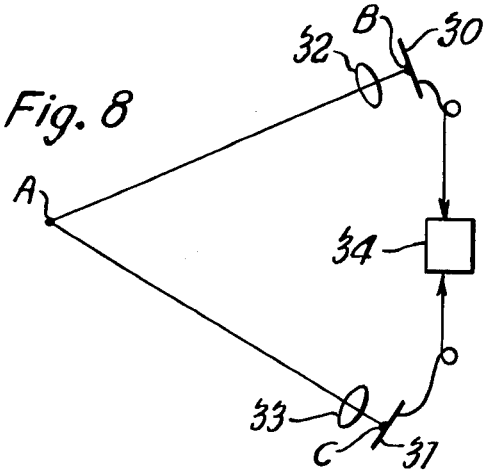
FIG. 8 shows a further embodiment using a range-finder technique

As an alternative to the viewing system of FIG. 7, a photo-electric system could be used as shown in FIG. 8. In FIG. 8 the reflecting surfaces 20 and 21 of FIG. 7 have been replaced by photo-electric devices, 30 and 31 and lenses 32 and 33 which focus the images from the track on to photo-electric devices 30 and 31. The electrical outputs from the photo-electric devices are fed to a comparator 34 which compares the two outputs and hence the two received images and produces as its output an electrical difference signal. Thus the system of FIG. 8 could replace the system of FIGS. 4 and 5, the output from the comparator being fed to the control unit 10 and the corresponding null point being when no difference signal is produced by the comparator.

Figure 9:
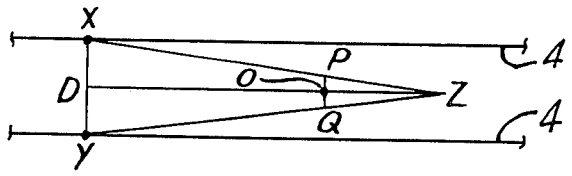
FIGS. 9 and 10 show in plan and elevation an embodiment of the invention using a tacheometry technique.
Figure 10:
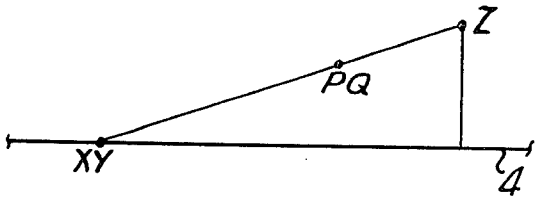

In FIGS. 9 and 10 is shown an embodiment of the invention using a tacheometry technique. In FIG. 9 the corners of the optical triangle are XYZ, Z being at the predetermined height and constituting the rear datum and the slope of the datum plane X Y Z being adjusted until the points X and Y lie in the plane of the track and, for example, each on a respective rail head of the track, which will only happen for one angle of slope of the plane. Thus the track gauge is used as the required constant spacing XY corresponding to the constant spacing BC of FIG. 2. The points PQ are the gauge lines on the viewing device so that viewed from point Z the gauge lines coincide with the rail-heads at X and Y.

It is to be noted that the optical datum establishing systems described above can be used for recording as well as for track level correction purposes. For example, referring to FIGS. 4 and 5, for a given inclination of the table 11, the displacement along the axis X—X of the reflected image from the null point C is a measure of track condition which can be registered in a recorder.

Figure 11:
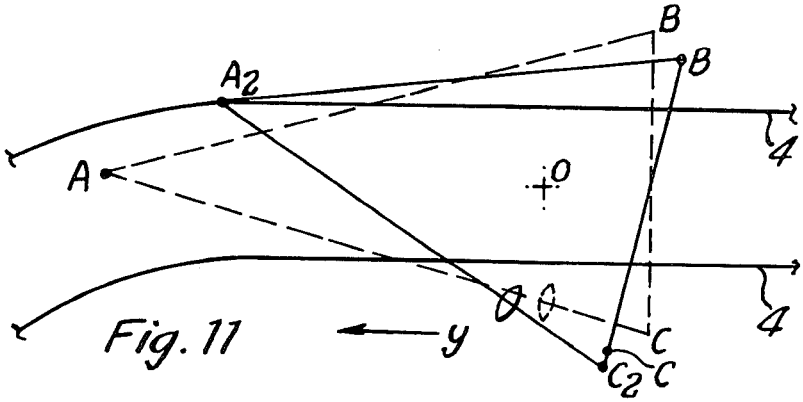
FIGS. 11 and 12 show in plan and elevation view one way in which the optical system in accordance with the invention can be adapted to accommodate curves in the track and to be used for determining the horizontal geometry of the track.
Figure 12:
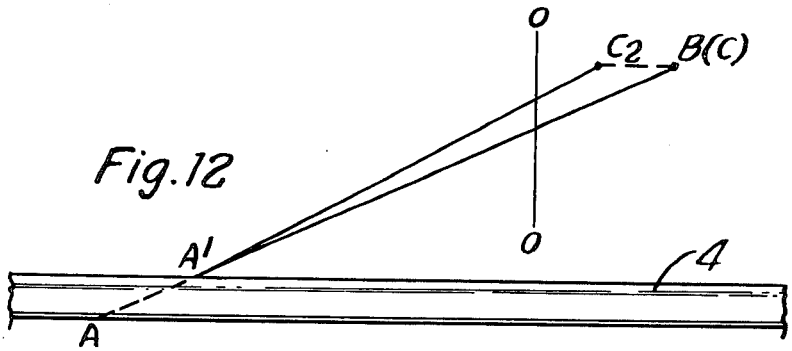

FIGS. 11 and 12 indicate one way in which the optical datum determining system of say FIGS. 4 and 5 can be adapted to negotiate curves in the track. The triangle ABC is the desired optical triangle corresponding to that shown in FIGS. 4 and 5.

When the machine is negotiating a curve, the point A will move towards one of the rails as shown in FIG. 11 and it may be necessary to locate this with respect to the rails 4. To do this it is first necessary to establish the position of the two rails and this can be achieved by rotation of the plane of the optical triangle ABC about a vertical or near vertical axis 0 so that the point A moves on to the head of the rail as indicated by point $A_2$ and length AB will be reduced by $AA_2$ to $A_2B$. Thus one of the rails 4 has been located. The other rail can be similarly located and the pivoting about axis 0 to the correct position between the rails can then be carried out.

Identification of the moment at which the illuminated spot mounts the rail is further aided by the relatively high reflectivity of the rail surface compared with that of the sleeper/ballast surface which will result in a larger proportion of the light from the emitter being reflected away from the image surface.

Simple logic mechanisms can be used to insure that movements of the image on the image surface due to curvature is not confused with movements due to a vertical irregularity. For example since lifting is performed with the machine 1 stationary, logic mechanisms can control rotation of table 11 about axis X—X so that this happens only when the machine is stationary and rotation of table 11 about vertical axis 0 when the machine is moving along the track.

The principle of detecting when the point A of the optical triangle mounts the rail head by rotation about axis 0 can be used to determine horizontal track geometry.

If the track suffers from short wave-length high-amplitude changes in level, point A of the optical triangle as it follows these changes will cause them to be reflected to a lesser degree in the lifted track. Such a disadvantage may be overcome by combining with an optical datum establishing system in accordance with the invention a conventional system such that the track lifting device is lifted to an average position of the optical triangle ABC during its passage over say the previous 10 sleepers of the track. Such a system is shown in FIG. 13.

Figure 13:
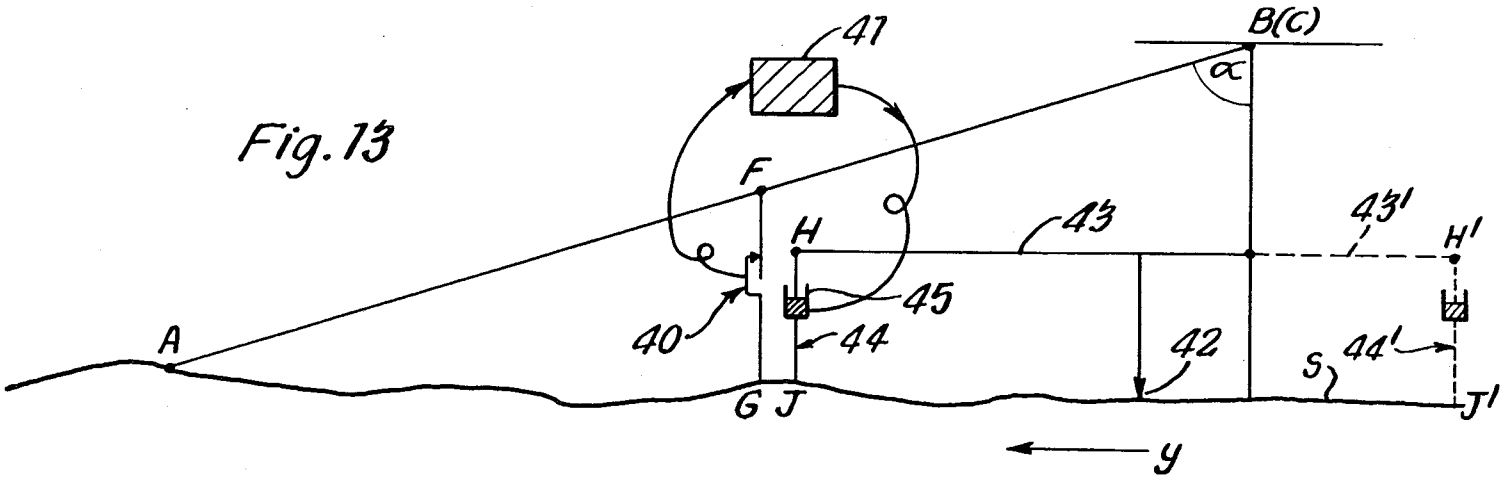
FIG. 13 shows diagrammatically how the optical system of the invention can be modified to incorporate an averaging system.

Referring to FIG. 13 the optical triangle ABC is the same as previously described. In this instance an intermediate reference device 40 e.g. a potentiometer is used which measures the change in the length FG as the optical triangle moves along the track and every sleeper feeds a related output voltage to an averaging control unit 41. The track lifting device is indicated at 42 and is arranged to lift to a datum line 43 supported by a variable length tower structure 44 supported on the track. The output from the unit 41 controls a length adjusted 45 in the tower so as to adjust the length HJ of the tower and hence the slope of the datum line 43. The change in length HJ is adjusted so that it is at all times equal to the average change in length that has taken place in FG over say the previous 10 sleepers. Alternatively to positioning the datum line supporting tower 44 on the uncorrected track, it could with advantage in some circumstances be placed on the already corrected track as indicated at 44' and be controlled similarly to control the height H'J'. The datum line 43' in this instance extends from H' to the lifting position and is pivoted intermediate its length.

Figure 14:
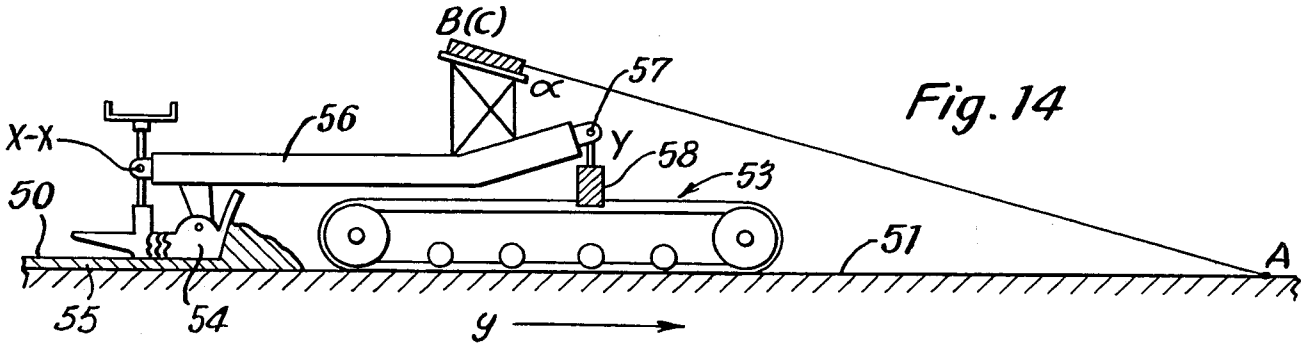
FIG. 14 shows the use of the system on a floating screed paver.

FIG. 14 shows the application of an optical datum establishing system in accordance with the invention to a floating screed paver to provide a new surface 50 on the existing surface 51 of a roadway. As is will known such a machine 53 moves along the existing surface 51 and by a screed 54 lays a layer of asphalt 55 on the existing surface. The screed is carried by a beam 56 supported at 57 on a vertically adjustable hydraulic jack 58 so that adjustment of the beam will cause it to pivot about horizontal axis X—X. Hence the angle of the screed relatively to the machine 53 can be achieved. Thus, notwithstanting that the machine follows undulations in the existing surface 51, the screed can be set to a substantially constant angle.

The optical datum establishing system indicated diagrammatically is mounted on a table supported on the beam 56. This system may for example take the form of an emitter, lens system and receiver as shown in FIGS. 4 and 5 and through a control unit will control operation of the jack 58 to maintain the optical triangle ABC in a closed loop control system. Hence the angle of the screed will be maintained at a value continuously related to the point A and since this is well ahead of the machine the vertical variations in the point A will only produce small errors in the angle of the conforming plate as explained in principle with reference to FIGS. 1 to 3.

I claim:

1. a movable optical system for establishing a reference datum in relation to the surface of a roadway, comprising:

a. a vehicle movable along a roadway, b. a support mounted on the vehicle and pivotable about a substantially horizontal axis extending transversely of the vehicle at a predetermined height, c. light emitting means mounted on said support and oriented to emit a beam of light along a first optical axis extending away from the pivotal axis of the support, d. light receiving means mounted on said support and spaced from said light emitting means and oriented to detect light along a predetermined second optical axis which converges with said first optical axis in a direction extending away from said pivotal axis of the support, e. an actuator mounted on the vehicle for adjusting the support about its pivotal axis whereby the said first and second optical axes can be caused to intersect at the surface of the roadway such that said receiving means receives along said second optical axis light from said beam reflected from the roadway, whereby an optical triangle is established, one corner of which is at the intersection if said first and second optical axes, and f. a device mounted on the vehicle spaced a constant horizontal distance from said horizontal axis and adapted to be adjusted vertically to maintain a predetermined vertical relationship with the plane of said optical triangle.

2. An optical system according to claim 1 wherein said device comprises a roadway working device which is adapted to be adjusted vertically so that it is maintained at a constant vertical distance below the plane of said optical triangle.

3. An optical system according to claim 1 wherein said device comprises a measuring device which measures the change in height between the plane of the optical triangle and the surface of the roadway as the optical system is moved to different positions along the roadway.

4. An optical system according to claim 1 wherein said receiving means comprises a photo-electric detector with an image receiving surface extending along said pivotal axis, said image receiving surface having a null position at a second corner of said optical triangle.

5. An optical system according to claim 4 wherein the output from said photo-electric detector is connected to said actuator for effecting pivotal movement of said support means, the operation of the actuator being arrested when the reflected image is at said null position of the receiving means.

6. An optical system according to claim 1 wherein said support is also pivotable about a substantially vertical axis whereby to adjust the orientation of said substantially horizontal pivotal axis with respect to the vehicle.

7. An optical system according to claim 2 wherein said support is mounted on a roadway working machine and said actuator is arranged to simultaneously effect controlled movement of said roadway working device.

8. An optical system according to claim 7 wherein said support is mounted on a railway track maintenance machine and said roadway working device is a track lifting device.

9. An optical system according to claim 7 wherein said support is mounted on a floating screed paver and said roadway working device is a screed.

10. An optical system according to claim 3 wherein said measuring device includes sensor means for detecting the change in height between the plane of the optical triangle and the surface of the roadway and to produce an electrical output related to said change in height, said electrical output being fed to averaging means which produce an output corresponding to the average value of said change in height over a predetermined number of readings.

* * * * *